United States Patent [19]

Yi

[11] Patent Number: 4,850,082

[45] Date of Patent: Jul. 25, 1989

[54] EASEL HINGE HAVING A WEDGING ACTION STOP

[75] Inventor: Han Ung Yi, Seoul, Rep. of Korea

[73] Assignee: Starlight Industries, Inc., Brooklyn, N.Y.

[21] Appl. No.: 271,739

[22] Filed: Nov. 15, 1988

[51] Int. Cl.[4] ..... E05D 1/04

[52] U.S. Cl. ..... 16/341; 16/355; 16/DIG. 29; 16/374

[58] Field of Search ..... 16/341, 342, 355, 356, 16/374, 376, 384, DIG. 29

[56] References Cited

U.S. PATENT DOCUMENTS

| | | | |
|---|---|---|---|
| 2,857,618 | 10/1958 | Jordan | 16/DIG. 29 X |
| 3,994,045 | 11/1976 | Roy | 16/355 |
| 4,050,117 | 9/1977 | Roy | 16/355 |
| 4,349,942 | 9/1982 | Roy | 16/356 X |

*Primary Examiner*—Fred A. Silverberg
*Attorney, Agent, or Firm*—Helfgott & Karas

[57] ABSTRACT

An easel hinge for supporting picture frames and the like comprises two hinge plate members each including a tubular wall. The tubular wall of one hinge plate member is inserted in the tubular wall of another hinge plate member with at least some non-congruent portions whereby the inner tubular wall can be rotated within the outer tubular wall. The outer tubular wall is open and has at its open edge a substantially straight lower end wall portion. When the inner hinge plate member strikes against the substantially straight lower end wall portion of the outer hinge plate member the plates are retained in the end angular position, and further angular displacement of the hinge plate members relative to each other is prevented.

11 Claims, 1 Drawing Sheet

EASEL HINGE HAVING A WEDGING ACTION STOP

BACKGROUND OF THE INVENTION

The present invention relates to easel hinges in general, and more particularly to hinges utilized for picture frame supports.

So-called easel hinges for joining the back surface of a picture frame to the top of a swingable support flap member are known, for example from U.S. Pat. Nos. 2,857,618; 3,994,045; 4,050,117 and 4,349,942. The U.S. Pat. No. 2,857,618 patent discloses a hinge construction in which pintles formed along an edge of one of the hinge leaves are caught within a triangularly-shaped socket formed along the edge of the other hinge leaf.

The U.S. Pat. No. 3,994,045 patent discloses an easel hinge including an outer hinge plate formed with a curled barrel at one end, and an inner hinged plate also provided with a curled barrel coaxial within the curled barrel of the outer hinge plate with both barrels curled in the same direction.

U.S. Pat. Nos. 4,050,117 and 4,349,942 both describe an easel hinge construction in which both barrels of two hinge plates are curled in the same direction.

In each of the above-discussed patents, stop means are provided on the hinge, which cause one hinge plate to stop in one or a plurality of angular positions relative to another hinge plate so as to spread apart the hinge plates and therefore pivot the support flap from the backing of the frame to permit the frame to stand in an open upright position.

The stop means of the hinge disclosed in the '618 patent is constructed as a friction catch which includes a first stop member engaging the pintle on the one leaf of the hinge to limit rotation of the hinge leaves relative to each other in one direction and a second stop member which engages the pintle in the one hinge leaf so as to limit relative rotation of that leaf in an opposite direction.

The stop means of the hinge described in U.S. Pat. Nos. 3,994,045; 4,050,117 and 4,349,942 is constructed by means of tangs or projections formed on one of the hinge leaves and cooperating, e.g. with edges of respective openings formed on another of the hinge leaves so as to provide for two independent and simultaneously acting stop means which ensure that a desired opening movement of the hinge leaves is securely limited.

It will be appreciated, however, that stop means utilized in all aforediscussed known hinge constructions require fairly high machining tolerances for manufacturing such hinges because not only the outer circumference of the curled barrel of the inner hinge leaf must closely fit within the inner periphery of the curled barrel of the outer hinge leaf to ensure steady rest positions but also all protruding parts of the hinge leaf, constituting the stop means must fit within the respective openings or recesses of the other hinge leaf.

SUMMARY OF THE INVENTION

It is an object of the present invention to provide a hinge construction for picture frame supports, in which the above and other drawbacks in conventional hinge constructions would be avoided.

It is another object of the invention to provide an improved hinge construction with stop means which is easy to use and inexpensive to manufacture.

Yet another object of the present invention is to provide a hinge construction which ensures a steady hinge joint between two hinge members over an entire path of swinging motion of the hinge members or plates.

According to the invention, an easel hinge comprises two plate members each having a substantially flat mounting portion and a tubular wall or barrel adjacent to the respective mounting portion. The tubular wall of the plate member which forms the inner hinge plate member is inserted in the tubular wall of the outer hinge plate member to permit angular displacement or pivoting motion of the plate members. The tubular wall of the outer hinge plate member includes two elongated tubular portions longitudinally spaced apart from each other by an elongated slot. The tubular walls or barrels of the respective hinge plates are curled in opposite directions and have portions which are non-congruent relative to each other. Due to such non-congruent arrangement the tubular wall of the inner hinge plate member is inserted in the tubular portions of the outer hinge plate member so that the tubular wall of the inner hinge plate member can be pivoted within the tubular portions of the outer hinge plate member only to a predetermined angular position. In addition, the tubular wall of the outer hinge plate member has a substantially straight or flattened wall portion at its lower end. The relative angular displacement of the two plate members is thus limited by the engagement of the tubular wall of the inner hinge plate member with the straight wall portion of the outer hinge plate member when a certain angular position is reached and the two hinge plate members are retained relative to each other in that certain angular position by that engagement.

In an embodiment, the easel hinge is provided with means preventing a longitudinal displacement of the plate members relative to each other. The plate member which represents the outer hinge plate member is formed with a tongue protruding inwardly of this plate member and received in a central opening formed in the plate member which is the inner hinge plate member. The tongue is bent to curl about a portion of the inner tubular wall which extends between two tubular portions of the outer tubular wall. The lateral edges of the curled tongue engage with the respective lateral edges of the two tubular portions of the outer hinge plate member thus preventing a longitudinal displacement of the two plate members relative to each other.

The various features of novelty which characterize the invention are pointed out with particularity in the claims annexed to and forming a part of the present disclosure.

For a better understanding of the invention, its operating advantages and specific objects attained by its use, reference should be had to the accompanying drawing and descriptive matter in which there are illustrated and described preferred embodiments of the invention.

DETAILED DESCRIPTION OF THE PREFERRED EMBODIMENT

Figure 1:
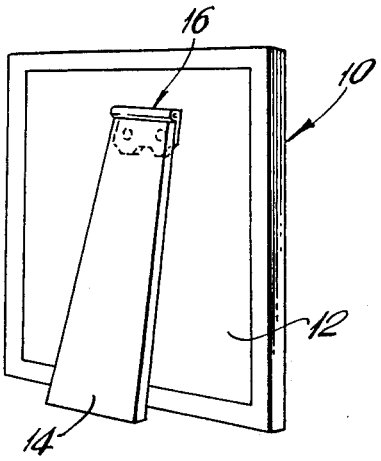
FIG. 1 is a perspective view of a picture frame taken from the rear with a supporting member joined to the frame by a hinge according to the invention.

Referring now to the drawings in detail, FIG. 1 shows the rear of a picture frame assembly generally designated at 10 and including a frame backing 12 and a swingable leg or support member 14 which is joined to the frame backing 12 by a hinge 16 constructed according to the present invention.

Figure 2:
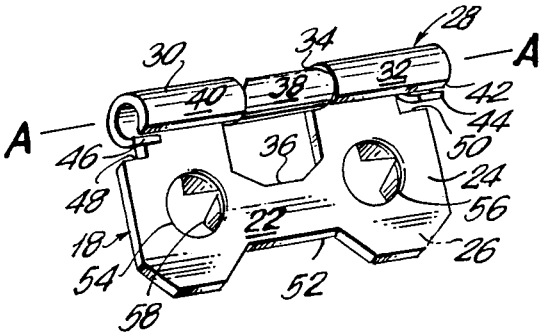
FIG. 2 is a perspective view of a first plate member of the hinge according to the invention.
Figure 3:
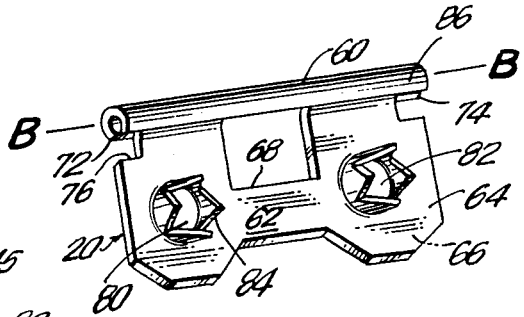
FIG. 3 is a perspective view of a second plate member of the hinge of the present invention.
Figure 4:
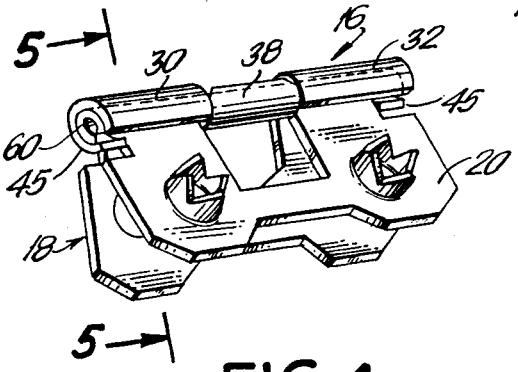
FIG. 4 is a perspective view of the hinge in the assembled state.

As shown in FIGS. 2,3 and 4, hinge 14 is comprised of a first plate member 18, which in assembly is the outer hinge plate member, and a second plate member 20 which constitutes the inner hinge plate member. Both plate members are rigid and can be formed of a hardened steel alloy or the like material by stamping, punching and bending techniques known in the art.

As best seen in FIG. 2, first plate member 18 includes a substantially flat mounting portion 22 having a top surface 24, and a bottom surface 26 which faces in the assembled hinge the inner surface of the second plate member. A substantially tubular wall or a curled barrel 28 is formed along a longitudinal edge of the flat mounting portion 22. Tubular wall 28 has a central axis A. Tubular wall 28 is subdivided into two longitudinally extended tubular portions or segments 30 and 32 which are longitudinally spaced from each other by a U-shaped channel 34. A generally central slot 36 is formed in the mounting portion 22 of the plate member 18. Slot 36 is of substantially rectangular configuration and is formed by punching-out a centrally disposed tongue 38 starting from the edge defining channel 34 in the tubular wall 28 and bent inwardly and upwardly of the mounting portion 22. Tubular portions 30 and 32 which are coaxial to each other and have common axis A have each a flat section 40 which has a terminal edge 42 defining an elongated bore 46 together with an opposing edge 44 of inwardly directed arcuate fingers 45 and the top surface of the mounting portion 22. Bore 46 of the two tubular portions 30 and 32 are in alignment with each other and permit receipt of the inner tubular wall of the second plate member 20 shown in FIG. 3 and described herein below. Hinges 45 of two tubular portions 30 and 32 are formed by the curled pieces punched out of the mounting portion 22 at its cutouts 48, 50. A generally central cutout 52 is punched at the lower edge of plate member 18.

A pair of mounting holes 54, 56 are punched through the mounting portion 22 of the first plate member 18 preferably forming sharp prongs 58 projecting from the bottom surface 26 of the mounting portion 22, e.g. outwardly of the hinge assembly. Prongs 58 enable the first plate member 18 to be securely fastened to the frame backing 12 and fix the first plate member 18 at a desired position without requiring additional fasteners.

Figure 6:
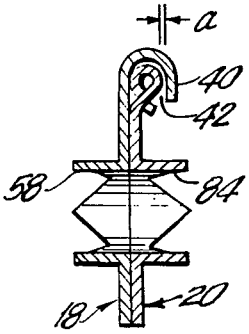
FIG. 6 is a sectional view similar to that of FIG. 5 but of the hinge in its closed position.

With reference to FIG. 3, it will be seen that the second plate member 20 has an elongated tubular wall 60 having a central axis B and a flat mounting portion 62 integral with a tubular wall or curled barrel 60 and having a top surface 64 and a bottom surface 66. Elongated tubular portion 60 is curled in the direction opposite to that of the tubular wall 28 of the first plate member 18 and has an external diameter which is somewhat smaller than the internal diameter of the two tubular portions 30 and 32 of tubular wall 28. The mounting portion 62 includes a substantially centrally positioned rectangular opening 68 which in assembly receives the bent tongue 38 of the first plate member 18. The tubular wall 60 is also of an open curl and its edge 72 defines with the mounting portion 62 an elongated slit 74 extending over the entire length of the tubular wall or barrel 60. Two lateral slots or recesses 76 are formed at two opposing edges of the mounting portion 62 to receive fingers 45. Fingers 45 are inwardly bent into slots 76 to define the arcuate outer barrel or tubular portion 30, 32 within which the inner tubular wall 60 can rotate. The configuration and size of the mounting portion 62 is substantially similar to those of the mounting portion 22 of the first hinge plate member 18. The tubular portion 60 has a wall 86 which in the assembled state of the hinge faces the inner surface of each tubular portion 30, 32 of the first plate member 18. Wall 86 may be round or flattened but in any case the tubular portion 60 is non-congruent with the tubular portions 30, 32 of the first plate member 18 so that a gap or clearance "a" is left between tubular portion 60 and tubular portions 30, 32 when the hinge is in its closed position as shown in FIG. 6 and will be explained in detail below.

A pair of mounting holes 80, 82 are punched through the second hinge plate member 20 so as to form sharp prongs 84 projecting from the upper surface 64 of the mounting portion 62.

In assembly the first and second plate members 18 and 20 which form the hinge 16 according to the present invention are placed with their mounting portions abutting each other in face-to-face relationship. In the assembled state shown in FIG. 4 the tubular wall or curled barrel 60 of the second plate which forms the inner hinge plate is inserted in the two tubular portions 30 and 32 of the tubular wall 28 of the first plate member 18 which constitutes the outer hinge plate while the intermediate portion of the tubular wall 60 fills the channel 34 between tubular portions 30 and 32. Tongue 38 formed on the top surface of the mounting portion 22 of the first plate member 18 and bent inwardly thereof projects through the opening 68 in the second plate member 20 and is curled about the intermediate portion of the tubular wall 60 filling channel 34 and extending between two tubular portions 30 and 32 of the tubular wall of the first plate member so that the opposite edges of the curled tongue 38 abut against respective edges of tubular portions 30 and 32 thus preventing a longitudinal displacement of the inner tubular wall or barrel 60 relative to the outer tubular wall or barrel 28.

As also seen in FIG. 4, the outer tubular wall 28 is substantially U-shaped with the front edge 61 pointing downward rather than inwardly. Likewise, the inner tubular wall 60 has its legs pinched together at 63. Due to this non-congruent arrangement of the hinge assembly the outer wall surface of the inner tubular wall 60 is spaced from the inner wall surface of the outer tubular wall 28 by a distance "a" (FIG. 6). As mentioned above, the inner and outer tubular walls 60, 28 of the second and first plate members, respectively, are curled in opposite directions.

Figure 5:
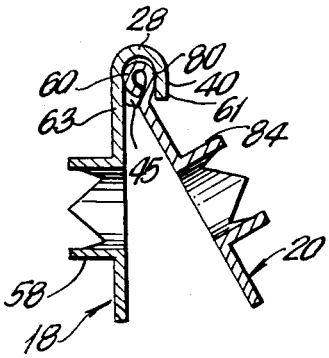
FIG. 5 is a sectional view taken along line 5—5 of FIG. 4 of the hinge in its open position.

As best seen in FIG. 5, the hinge plate members 18, 20 can freely rotate relative to each other about the hinge point formed by the tubular walls 28 and 60. As the first and second plate members 18, 20 are rotated to a certain angular position, the inwardly pinched section 63 of the tubular wall 60 strikes or firmly engages against the inner walls of the downwardly directed front wall 61 of the two outer tubular portions 30 and 32 of the first plate member 18 thus preventing a further angular displacement of the plate members relative to each other (FIG. 5). This striking effect is produced due to the non-congruent arrangement resulting in the angular spacing "a" of the ends of the tubular walls of the inner and outer hinge plate members and due to the provision of the downward edge 61 of the outer tubular wall. By adjusting the angular spacing "a" in manufacturing of the hinge, the range of pivoting of the hinge plate members 18, 20 about the hinge point formed by their tubular walls can be adjusted.

While the foregoing description represents preferred embodiments of the present invention, it will be obvious to those skilled in the art that various changes and modifications may be made, without departing from the spirit and scope of the present invention.

What is claimed is:

1. An easel hinge comprising:

a first plate member including a first mounting portion and a first substantially tubular wall which includes two longitudinally spaced concentrical tubular portions formed along an elongated distal end of said first mounting portion and each having a lower end portion; and a second plate member including a second mounting portion and a second substantially tubular elongated wall inserted into said first tubular wall for relative rotation therein;

said first tubular wall and said second tubular wall being curled in two opposite directions and being non-congruently positioned relative to each other whereby, upon rotating said first and second plate members from a first end position, in which said first and second mounting portions overlap each other, to a second end position, in which said first and second mounting portions are angularly displaced relative to each other, said second tubular wall wedges against an inner surface of said lower end wall portion of each tubular portion of said first tubular wall whereby said first tubular wall now in wedging contact with said second tubular wall stops a further relative angular displacement of said first and second plate members in said second end position while also leaving a gap between said second plate member and a free end of said first tubular wall at said second end position.

2. The easel hinge as in claim 1, and further comprising means for preventing a relative longitudinal displacement of said first and second tubular walls.

3. The easel hinge as in claim 2 wherein said preventing means including a tongue formed on said first mounting portion and bent inwardly therefrom, said second mounting portion having an opening receiving said tongue, said tongue being curled about a portion of said second tubular wall extending between said two tubular portions of said first tubular wall and laterally engaging two opposing edges of said spaced tubular portions.

4. The easel hinge as in claim 3, wherein said tongue is centrally disposed on said first mounting portion.

5. The easel hinge as in claim 4, wherein said opening is substantially rectangular.

6. The easel hinge as in claim 5, wherein said opening is disposed centrally in said second mounting portion.

7. The easel hinge as in claim 3 wherein said tongue is bent in a direction opposite to that of said tubular portions.

8. The easel hinge as in claim 1 wherein said end wall portion is substantially non-arcuate.

9. The easel hinge as in claim 1, wherein said first mounting portion is formed with an elongated slot extending between said two tubular portions.

10. The easel hinge as in claim 1, wherein each of said tubular portions is open at a side thereof facing said first mounting portion.

11. The easel hinge as in claim 1, wherein each of said tubular portions includes a finger bent inwardly of said first mounting portion and defining a substantially arcuate shape of the respective tubular portion.

* * * * *